US008062389B2

(12) United States Patent
Pisklak et al.

(10) Patent No.: US 8,062,389 B2
(45) Date of Patent: Nov. 22, 2011

(54) LOW VAPOR PRESSURE FUELS FOR USE IN CATALYTIC BURNERS

(75) Inventors: Thomas J. Pisklak, Dallas, TX (US); Kenneth J. Balkus, Jr., The Colony, TX (US)

(73) Assignee: The Board of Regents of the University of Texas System, Austin, TX (US)

( * ) Notice: Subject to any disclaimer, the term of this patent is extended or adjusted under 35 U.S.C. 154(b) by 1164 days.

(21) Appl. No.: 11/704,108

(22) Filed: Feb. 8, 2007

(65) Prior Publication Data

US 2008/0014539 A1 Jan. 17, 2008

Related U.S. Application Data

(60) Provisional application No. 60/771,618, filed on Feb. 8, 2006, provisional application No. 60/771,918, filed on Feb. 8, 2006.

(51) Int. Cl.
*C10L 1/18* (2006.01)

(52) U.S. Cl. ..... 44/451; 44/308; 44/354; 44/388; 44/389; 44/437; 44/438; 44/443; 44/452

(58) Field of Classification Search ..... 44/445, 44/451, 388, 389, 447, 437, 438, 443, 308, 44/354, 452
See application file for complete search history.

(56) References Cited

U.S. PATENT DOCUMENTS

| | | | | |
|---|---|---|---|---|
| 2,229,215 | A * | 1/1941 | Magruder, Jr. et al. | 44/350 |
| 4,624,633 | A * | 11/1986 | Bandel | 431/320 |
| 4,666,671 | A * | 5/1987 | Purzycki et al. | 422/5 |
| 6,451,841 | B2 | 9/2002 | Lehoux et al. | 514/421 |
| 6,537,061 | B1 | 3/2003 | Gomez et al. | 431/268 |
| 6,814,929 | B2 | 11/2004 | Lehoux et al. | 422/4 |

* cited by examiner

*Primary Examiner* — Cephia D Toomer
(74) *Attorney, Agent, or Firm* — Winstead PC

(57) ABSTRACT

Low vapor pressure compound-based fuels are provided. These fuels are useful in catalytic burner systems that can be used to disperse fragrances, insecticides, insect repellants (e.g., citronella), aromatherapy compounds, medicinal compounds, deodorizing compounds, disinfectant compositions, fungicides and herbicides.

7 Claims, 1 Drawing Sheet

LOW VAPOR PRESSURE FUELS FOR USE IN CATALYTIC BURNERS

CROSS REFERENCE TO RELATED APPLICATIONS

This application claims the benefit of U.S. Provisional Application No. 60/771,618, filed Feb. 8, 2006 and U.S. Provisional Application No. 60/771,918, filed Feb. 8, 2006.

BACKGROUND OF THE INVENTION

Flameless catalytic fragrance lamps that auto-catalytically burn a fragrance/fuel mixture to emit a fragrance have been available for over 100 years. The typical fragrance lamps burn fuel that is composed of approximately 90 wt % 2-propanol, 8 wt % water, and 2 wt % fragrance. Currently, there are several flameless catalytic lamps available on the market. The catalytic fragrance lamps currently employ low boiling alcohol-based fuel for several reasons. The fuel is used as a carrier for the fragrance. The fragrance/alcohol mixture is transported from a reservoir to a flameless catalytic burner which simultaneously combusts the alcohol while dispersing the fragrance in the surrounding atmosphere. Alcohols are also used because their high vapor pressure (2-propanol has a vapor pressure of 42.74 mm Hg at 25° C.) allows them to soak the wick, which transports them to the burner very efficiently and allows a sufficient, continual flow of fuel from the reservoir to the catalytic burner. Furthermore, combustion of low boiling alcohols by the catalytic burner produces only small amounts of carbon, or coke, which over several months of intermittent use will cause the catalytic burner to clog and cease operation. Finally, catalytic combustion of 2-propanol produces almost no smoke, so the fragrance is released while not producing any visible smoke from the catalytic fragrance lamps.

However, currently used fuel mixtures will likely face severe use restrictions in the future by regulatory bodies seeking to minimize pollution. The California Air Resources Board (CARB) plans to impose bans on currently used fuel mixtures that contain greater than 18 wt % of alcohol-based fuels. As an example, 2-propanol is classified as a volatile organic compound (VOC), and currently used fuel mixtures contain greater than 18 wt % of 2-propanol relative to the total composition.

In light of the environmental and pollution concerns surrounding currently used fuel mixtures, it is desirable to develop new low vapor pressure fuels (LVP) and fuel compositions for use in catalytic fragrance lamps that meet or exceed VOC regulations imposed by regulatory bodies such as CARB. The present invention is directed to the identification and synthesis of compounds that will meet the above mentioned requirements and function as suitable fuels for catalytic fragrance lamps.

SUMMARY OF THE INVENTION

The invention is directed to a burner system comprising at least one molecule sieve, wherein the burner comprises an upper portion and a lower portion, a catalyst, wherein said catalyst is dispersed within the upper portion of the burner, a wick, wherein the wick comprises an upper portion and a lower portion, the upper portion of the wick being connected to the lower portion of the burner; and, a reservoir, wherein the reservoir houses a liquid fuel mixture that is contacted by the lower portion of the wick, and the liquid fuel mixture comprises at least one compound having a vapor pressure of less than 0.5 mm Hg at 25° C.

The invention is also directed to a system for the delivery of a volatile compound comprising a liquid fuel mixture, wherein said liquid fuel mixture comprises up to 20 wt % of a volatile compound, up to 18 wt % of a first compound having a vapor pressure greater than 0.5 mm Hg and, 60-100 wt % of a second compound having a vapor pressure less than 0.5 mm Hg.

DETAILED DESCRIPTION OF EXEMPLARY EMBODIMENTS

Figure 3:
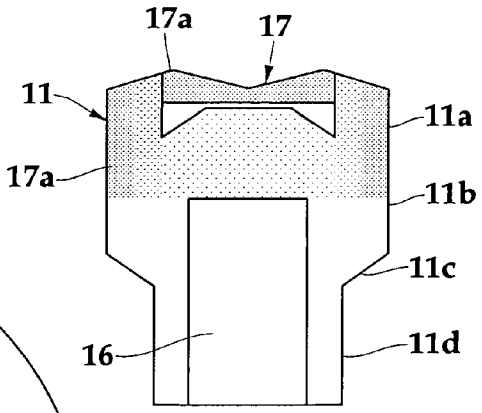

An embodiment of the invention provides a flameless catalytic burner that is constructed of highly porous crystalline materials, such as zeolites, that provide a flow rate of low vapor pressure fuels that is sufficient to allow a catalyst to function, but low enough to prevent the fuel from extinguishing the catalyst. A preferred fuel travel rate in a zeolite-based burner ranges from 0.3 ml/min to 1.0 ml/min. An optimal or preferred fuel travel rate in a zeolite-based burner is 0.6 ml/min.

In an embodiment of the invention, a molecular sieve-based burner is composed of a shaped structure comprising an upper portion that contains a catalyst. The lower portion of the burner does not contain catalyst, and is shaped with a shoulder that facilitates placement of the burner in a reservoir. The upper portion of the burner can be of any shape having linear edges including, pyramidal, octagonal, or hexagonal. This lower portion of the burner sits on top of a reservoir having a neck, which in turn permits the shoulder of the burner to contact the neck of the reservoir. The lower portion of the burner is connected to an upper portion of a wick. The lower portion of the wick contacts a fuel mixture located in the reservoir. The wick transports the fuel mixture from the reservoir to the catalyst.

In certain embodiments of the invention, the wick is constructed from a porous material. In an embodiment of the invention, the wick is made of zeolites. In another embodiment of the invention, the wick is made of cloth, for e.g., woven cloth wick or a woven cotton wick. In certain embodiments of the invention, the wick is constructed from porous materials other than zeolites, such as porous ceramic materials.

The wick of the present invention is a solid structure which, unlike wicks used in prior art burner systems, does not contain a concentric hole along its longitudinal centerline.

An embodiment of the invention provides a zeolite-based flameless catalytic burner that can reach a higher working temperature than currently available burners. This feature reduces the emission of VOCs from the burner, which in turn reduces coking.

A specific industrial application for a catalytic burner is its use in a flameless lamp. However, one of ordinary skill in the art would readily recognize that the catalytic burner described herein has numerous industrial applications including, portable stoves, radiant heater, dispersant systems for various as fragrances, insecticides, insect repellants (e.g., citronella), aromatherapy compounds, medicinal compounds, deodorizing compounds, disinfectant compositions, fungicides and herbicides; heat producing components in portable heat pumps, micro-chemical reactor system, heat source in portable warmers, and any application in which a portable heater is required.

An embodiment of the invention relates to a catalytic burner made of a porous molecular sieve material on which a metal catalyst is supported. The porous structure absorbs fuel, which is catalytically combusted by catalyst that is supported on the burner.

Figure 1:
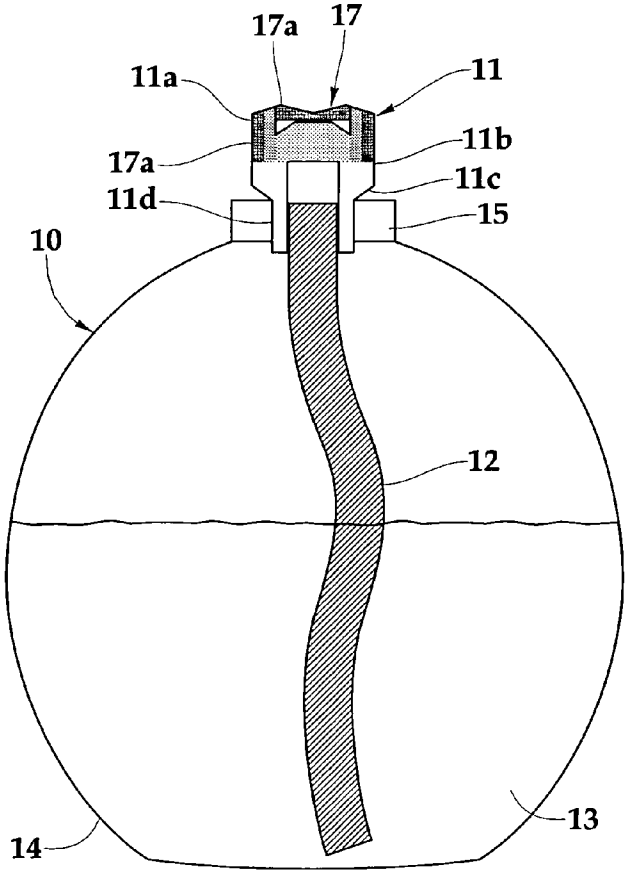
FIG. 1 is a longitudinal cross-section of a first catalytic burner system that is used in an embodiment of the invention.

As depicted in FIG. 1, a catalytic burner system 10 comprising a burner 11 and wick 12 is shown. The burner 11 comprises an upper portion 11*a*, and a lower portion 11*b*. The lower portion of the burner 11*b* comprises a shoulder 11*c*. The burner 11 further comprises a vertical portion 11*d* that extends below the shoulder 11*c*. The lower portion of the burner tapers inward such that the diameter of the lower portion of the burner is smaller than the diameter of the upper portion of the burner. The diameter of the upper portion of the catalytic burner shown in FIG. 1 ranges from 1.0 to 2.0 cm, and the length of the burner ranges from 1.0 to 2 cm. A close-up view of the burner is illustrated in FIG. 3.

The upper portion of the burner 11*a* comprises catalyst 17 that is distributed throughout the structure of the upper portion of the burner. The distribution of the catalyst is more concentrated on the peripheral portion of the burner 17*a*, than in the inner portion of the burner 17*b*. Thus a concentration gradient ranging from high to low is established from the peripheral portion of the burner to the inner portion of the burner.

The wick 12 is connected to the burner 11 by insertion into a space 16 located within the lower portion of the burner. The wick 12 may be removably or permanently connected to the burner 11, depending on the type of wick used. The length of the wick 12 depicted in FIG. 1 is approximately 12 cm. The wick does not contain any catalyst, and is typically shaped like a cylinder and is smaller in diameter (0.5 to 1.5 cm) than the upper portion and has a length between 2.0 to 12.0 cm. In an embodiment of the invention, the wick ranges in length from 10 to 12 cm. The wick extends into the fuel reservoir and contacts the fuel present in the reservoir. The fuel is absorbed by the wick, and travels up the length of the wick to the burner. In the case of a porous wick, the fuel enters the pores of the wick and travels through the pores from the reservoir through the burner structure, and comes in contact with the catalyst.

Figure 2:
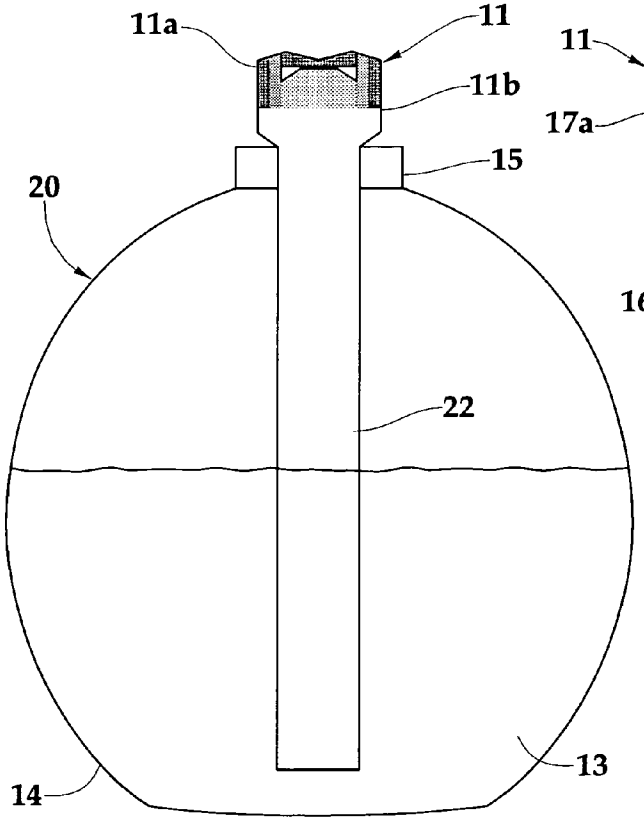
FIG. 2 is a longitudinal cross-section of a second catalytic burner system that is used in an embodiment of the invention; and, FIG. 3 is a longitudinal cross-section of a catalytic burner that is used in an embodiment of the invention.

The embodiment of the invention depicted in FIG. 2 is a catalytic burner system 20 having a burner 11 and a porous, non-cloth wick 22. The wick 22 can be either removably or permanently connected to the burner 11. All aspects of the catalytic burner system 20 show in FIG. 2 are similar to the system show in FIG. 1, except for the difference in the type of wick used in the two systems.

The upper portion of the burner 11 containing the catalyst is contacted with a source for igniting the catalyst such as lighter, match or any heat source that will cause the fuel to combust, in order to burn the fuel that travels up the wick from the reservoir to the upper portion of the burner.

The catalytic burner is constructed of highly porous materials such as molecular sieves. A particular type of molecular sieve that can be used in the construction of the burner includes zeolites. Zeolites are crystalline microporous aluminosilicates with pores having diameters in the range of 0.2 to 1.0 nm and high surface areas of up to 1000 $m^2/g$. Zeolite crystals are characterized by one to three-dimensional pore systems, having pores of precisely defined diameter. The corresponding crystallographic structure is formed by tetrahedras of ($AlO_4$) and ($SiO_4$), which form the basic building blocks for various zeolite structures. Due to their uniform pore structure, zeolite crystals exhibit the properties of selective adsorption and high adsorption capacities for LVP fuels. All zeolites have ion-exchange ability and can exchange $H^+$ for cations such as $Na^+$ and $K^+$.

Zeolites have a Si/Al ratio ranging from 1-∞ but preferably greater than 60. EXAMPLEs of zeolites that may be used in the construction of catalytic burners include, without limitation, all forms of ZSM-5, silicalite, all forms of mordenite, all forms of zeolite Y, all forms of zeolite X, all forms of zeolite A, all MFI type zeolites, all faujasite type zeolites, all forms of zeolite β, all forms of zeolite UTD-1, all forms of zeolite UTD-12, all forms of zeolite UTD-13, all forms of zeolite UTD-18, all forms of MCM-22, all forms of ferrierite, and all naturally occurring zeolites. The burners of the claimed invention may also be constructed from mesoporous materials such as DAM-1, MCM-41, MCM-48, SBA-15, MSU, and MBS.

Zeolite-based burners are highly porous and allow the fuel to travel from the reservoir through the zeolite material at far greater rates than contemporary flameless catalytic burners constructed from macroporous materials. Typical fuel travel rates in zeolite-based burners are 0.2 ml/min to 0.8 ml/min. An optimal or preferred fuel travel rate in a zeolite-based burner is 0.6 ml/min. The surface area of the zeolite-based catalytic burners ranges from 10 $m^2/g$ to 1000 $m^2/g$, and is preferably at least 400 $m^2/g$.

The zeolites are ion exchanged with combustion metal catalysts such as platinum, palladium, and rhodium and combinations thereof. This ion exchange process facilitates the uniform dispersion of the catalyst throughout the structure of the burner. Additionally, the small pore size of the zeolites induces the formation of metal nanoparticles, which exposes a greater surface area of the metal catalysts and leads to more efficient and complete combustion of the fuel. The small pore size of the zeolites further facilitates an improvement in the level of VOC emissions because of their high adsorption capacities for LVP fuels relative to prior art burners made of macroporous materials. Thus, zeolite-based burners are environmentally friendly relative to prior art burners, particularly with respect to their improved VOC emissions and their ability to burn low LVP fuels.

An embodiment of the invention provides a zeolite-based flameless catalytic burner that can reach a higher working temperature (>275° C.) than currently available burner. This feature reduces the emission of VOCs from the burner, which in turn reduces coking. The increased operating temperature of the current invention is in part due to more efficient catalyst dispersion in the material, as well as the ability of the fuel to travel through the burner at faster and more uniform rate. Whereas current catalytic burners have the catalyst located only on the surface of the ceramic burner, a zeolite-based burner has catalyst dispersed throughout the structure of the burner by virtue of the ion exchange properties of zeolites.

In certain embodiments of the invention, the silicon/catalyst (Si/Cat.) ratio of the structure of the zeolite-based burner may range from 100 to 5. In an embodiment of the invention, the Si/Cat. ratio at the surface of the burner is approximately 25. This ratio decreases in a gradient-like manner from the surface to the center of the burner.

The burner of the claimed invention further comprises a binder. The binder, as used herein, refers to any material which upon heating, binds together to form a rigid structure. EXAMPLEs of materials that can be used as binders include materials such as, without limitation, bentonite, hectorite, laponite, montmorillonite, ball clay, kaolin, palygorskite (attapulgite), barasym SSM-100 (synthetic mica-montmorillonite), ripidolite, rectorite, optigel SH (synthetic hectorite), illite, nontronite, illite-smectite, sepiolite, beidellite, cookeite, or generally any type of clay, borosilicate glass, aluminosilicate glass, or glass fibers.

The binder is not necessarily limited to a single component but instead may comprise a mixture of two or more binders, such as 0-15% bentonite and 85-100% laponite. In an embodiment of the invention, a binder mixture comprising 0-15 wt % bentonite and 85-100 wt % laponite is used in the construction of a catalytic burner.

The increased working temperatures of zeolite-based burners can also be achieved by the addition of a high thermal conductivity material, such as boron nitride (BN). The BN increases the thermal conductivity of the monolith and thus higher temperatures are achieved. A thermal conductor, as used herein, is any material which assists in the transfer of heat through the burner structure. In addition to boron nitride, thermal conductors include materials such as, without limitation, steel, stainless steel, transition metals, carbon nanofibers, carbon nanotubes, or diamond.

Additionally, the catalytic burner structure may contain additives that enhance the combustion of organic compounds. These additives include materials such as, without limitation, octahedral layered manganese oxide (OL-1), octachedral molecular sieve (OMS-1), manganese oxide, or perovskites.

An embodiment of the invention comprises about 15 wt % binder, about 84 wt % molecular sieve, and about 1 wt % thermal conductor.

In an embodiment of the invention, the catalyst which is embedded throughout the structure of the catalytic burner, is a metal catalyst comprising a single metal or a mixture of two or more metals. EXAMPLEs of metals that are used as catalysts in embodiments of the invention include, without limitation, gold, manganese, cerium, cobalt, copper, lanthanum platinum, palladium, and rhodium and combination thereof. However, one of ordinarily skill in the art would recognize that any metal that enhances the combustion or oxidation of the fuels may be used as a catalyst in embodiments of the invention, including metals in Group VIII.

In certain embodiments of the invention, the dispersed catalyst is comprised of 1-100 wt % platinum and 0-99 wt % rhodium. In other embodiments of the invention, the catalyst comprises about 75 wt % platinum and about 25 wt % rhodium.

The catalytic burner systems of the invention present several advantages over existing burners. Firstly, the construction of the burner using zeolite or molecular sieve materials permits the sequestration of the catalyst in the pores of the molecular sieve. This allows placement of the catalyst in specific areas of the upper portion of the burner, and also permits the introduction of other metals into the pores. Secondly, the porosity of the molecular sieves facilitates the increased flow of fuel through the system. The walls of the pores of the molecular sieves are themselves extremely porous, unlike the pore walls of macroporous ceramic materials that have low porosity and prevent flow of fuel. Consequently, zeolite-based burners have a higher flow rate and flow volume. Since flow rate and flow volume together dictate how fast and how much fuel reach the catalyst, higher flow rates and volumes promote higher temperature of the catalyst. The ability of zeolites to selectively adsorb molecules allows for more control over the chemistry of the catalyst and the burner materials. These properties provide advantages in adapting the chemistry of the burners for future applications that include changes in fuel composition.

In certain embodiments of the invention, the fuel mixture housed in the reservoir is a liquid fuel mixture. The preferred liquid fuel for use is a low vapor pressure (LVP) fuel that generates lower amounts of VOCs than traditional fuels. Traditional fuels typically have high vapor pressures of greater than 1 mm Hg. Table 1 below lists the vapor pressure(s) of several organic compounds. These compounds represent examples of high vapor pressure compounds that are undesirable for use in the fuel mixtures of the present invention.

TABLE 1

| Organic Compound | Vapor Pressure (25° C., mm Hg or Torr) |
|---|---|
| 2-propanol | 42.74 |
| Butanol | 6.15 |
| Ethanol | 59.02 |
| Methanol | 129.05 |
| Butane | 1821.22 |
| Octane | 13.95 |

The LVP fuels are organic compounds that can be burned by the catalytic burner and which conform to the CARB specifications for low vapor pressure fuels or as exempt compounds under CARB guidelines.

In certain embodiments of the invention, LVP fuels have a vapor pressure of less than 0.5 mm Hg. In other embodiments of the invention, LVP fuels preferably have a vapor pressure of less than 0.1 mm Hg.

In certain embodiments of the invention, an LVP fuel is a chemical compound having more than 12 carbon atoms. A preferred LVP fuel is a chemical compound having a boiling point greater than 216° C., or is the weight percent of a chemical mixture that boils above 216° C., but preferably with no aromaticity or Pi bonding, with an oxygen content of 6-40 atomic percent, but preferably ~25 atomic %.

In certain embodiments of the invention, the LVP fuel is an organic compound that does not deactivate the catalyst. Such compounds typically include those that do not contain sulfur. One reason for the exclusion is that the presence of sulfur has a tendency to deactivate the catalyst.

Without limitation, LVP fuels may be ethylene glycol, triethyelene glycol, diethylene glycol, 2-(2-ethoxyethoxy) ethyl acetate, triethylene glycol dimethylether, triethylene glycol monomethylether, diethylene glycol monbutyl ether acetate, diethylene glycol monoethyl ether, diethylene glycol monbutyl ether, oxalic acid ethyl ester diester with triethylene glycol, oxalic acid ethyl ester diester with diethylene glycol, oxalic acid ethyl ester diester with ethylene glycol, oxalic acid 2-(2-ethoxyethoxy)ethyl ethyl ester, oxalic acid 2-(2-ethoxyethoxy)ethyl methyl ester, oxalic acid ethyl 2-methoxyethyl ester, jojoba oil, jojoba biodiesel, soy biodiesel, canola biodiesel, or rapeseed biodiesel.

The fuel mixture may be composed of 0-20 wt % volatile compounds, 0-18 wt % high vapor pressure compounds such as, but not limited to, methanol, ethanol, propanol, butanol, acetone, or a mixture of two or more high vapor pressure compounds; and 62-100 wt % low vapor pressure fuel, or a mixture of two or more low vapor pressure fuels or CARB exempt compounds.

As used herein, a "high vapor pressure" compound is one that has a vapor pressure of greater than 0.5 mm Hg at 25° C.

The volatile compounds used in the fuel mixtures may be fragrances, insecticides, insect repellants (e.g., citronella), aromatherapy compounds, medicinal compounds, deodorizing compounds, disinfectant compositions, fungicides and herbicides The fuel mixture may also contain a catalyst dissolved homogenously in the fuel such as, but not limited to, ruthenium salts, magnesium salts, platinum salts, cerium salts, iron salts, transition metal ions, glyoxal, or any catalyst that is soluble in the LVP fuel. The catalyst may be present at a concentration ranging between 0.0001 ppm to 1.0 ppm.

In certain embodiments, the fuel mixtures may contain combustion promoters such as, but not limited to, hydrogen peroxide, organic peroxides, ferrocene, potassium nitrate, sodium nitrate, or any compound that is soluble in the LVP fuel, and promotes the complete combustion of the LVP fuel. The combustion promoter may be present at a concentration ranging between 0.0001 ppm to 1.0 ppm.

To quantify an LVP fuel or fuel composition as suitable for use in catalytic fragrance lamps a rating system was developed ("S rating") in which a compound which emits large volumes of black smoke and odor is denoted as a 10 on the scale and a compound which emits little or no white smoke and undetectable odor upon catalytic combustion is denoted as 1.

WORKING EXAMPLES

To determine the suitability of a fuel for use with flameless catalytic lamps all fuels were tested under the following conditions. All fuels were combusted using a catalytic burner composed of 82 wt % zeolite (ZSM-5, Si/Al=220), 15 wt % borosilicate glass, 2 wt % bentonite, and 1 wt % boron nitride. The burner was formed into the pyramid shape and fired at 1000° C. The burner was treated with a platinum-rhodium (70:30 mol %, respectively) solution, the silicon to catalyst ratio was 27. All fuels were mixed with 2-propanol and fragrance oil prior to testing. A typical composition is 75.2 ml LVP fuel, 23.7 ml 2-propanol, and 1.1 ml lemongrass sage fragrance oil (80:18:2 wt %, respectively).

Example 1

Commercially Available LVP Fuels

Low vapor pressure fuel mixtures are composed of 80 wt % LVP fuel, 18 wt % alcohol, and 2 wt % fragrance oil. The commercially-available LVP fuels (Table 1) were used as received. A typical composition is 75.2 mL LVP fuel, 23.7 mL 2-propanol, and 1.1 mL lemongrass sage fragrance oil. The resulting mixture is burned by the aforementioned catalytic burner to emit fragrance.

Table 2 shows the compounds tested as commercially available LVP fuels along with their properties. Compound 1 showed the best properties for use as a low vapor pressure fuel of all the fuels tested, including biodiesels and synthetic fuels. The operating temperature of Compound 1 was 274° C., which was the highest of the fuels tested. It also produced no soot during ignition and also the lowest amount of smoke of any of the compounds. After several trials there was no noticeable coke build-up.

Compounds 2 and 3 had similar operating temperatures at 252 and 251° C., respectively. They are both acceptable compounds for use as LVP fuels. They were given a slightly higher S rating (S=3) than Compound 1 (S=2) due to the fact they both produced slightly more smoke and odor. With both compounds, there was no soot on ignition and no noticeable coke build-up. Compound 4 had a slightly lower operating temperature (195° C.) its properties during combustion were similar to 2 and 3, and therefore was given an S rating of 3.

Compounds 5 and 6 produced noticeably more smoke than the previous commercially available LVP fuels. Also, there odor was more noticeable, while their odor didn't mask the odor of the lemongrass sage, they definitely affected it. They both produce no soot on ignition and no noticeable coke, and burned at relatively high temperatures (217 and 213° C., respectively). Due to these factors Compounds 5 and 6 were given an S rating of 4.

Compounds 7-9 were the last of the compounds with an S rating of 4. Compound 7 had a much higher operating temperature (200° C.) than 8 or 9 (183 and 160° C.). Compound 7 produced little soot during ignition and no coke over several trials, but the odor was dedectable and affected that of the fragrance. It produced slightly more smoke during operation than Compounds 5 and 6, but its odor was slightly less. Compounds 8 and 9, while burning at lower temperatures (183 and 160° C., respectively), had properties similar to compound 7.

TABLE 2

| Compound No. | Name | Bp (° C.) | Vapor Pressure (25° C., mm Hg or Torr) | No. of Carbons | Burn Temp. (° C.) | S rating |
|---|---|---|---|---|---|---|
| 1 | 1,2-ethanediol | 197.5 | 0.0959 | 2 | 272 | 2 |
| 2 | Triethylene glycol | 288 | 0.000268 | 6 | 252 | 3 |
| 3 | Diethylene glycol | 245.7 | 0.00469 | 4 | 251 | 3 |
| 4 | 2-(2-ethoxy ethoxy) ethyl acetate | 214 | 0.105 | 8 | 130 | 3 |
| 5 | Triethylene glycol dimethylether | 216 | 0.21 | 8 | 217 | 4 |
| 6 | Triethylene glycol monomethylether | 233 | 0.01 | 7 | 213 | 4 |
| 7 | Diethylene glycol monbutyl ether acetate | 247 | 0.0294 | 10 | 200 | 4 |
| 8 | Diethylene glycol monoethyl ether | 215 | 0.0292 | 7 | 183 | 4 |
| 9 | Diethylene glycol monbutyl ether | 228 | 0.0126 | 8 | 160 | 4 |

Example 2

Synthetic LVP Fuels

Low vapor pressure fuel mixtures composed of synthetic fuels were prepared as follows. The synthetic LVP fuels (Table 3) were synthesized from a condensation reaction utilizing an acid chloride and an alcohol or diol. In a typical reaction, 77.9 mL of diethylene glycol is dissolved in 150 mL dichloromethane and added to a round bottom flask. Then, 33.2 mL of ethyl chlorooxoacetate is dissolved in 150 mL dichloromethane and added to a constant pressure addition funnel. The ethyl chlorooxoacetate solution is added dropwise, at room temperature, to the stirring diethylene glycol solution. The reaction is allowed to proceed at room temperature for 6 hours. The solution is then poured in a separatory funnel and washed with 600 mL of saturated sodium bicarbonate solution. The organic layer is then separated and dried over magnesium sulfate. The magnesium sulfate is filtered off and the organic layer collected. The dichloromethane is removed via rotary evaporation to yield the desired product.

A typical composition is 75.7 mL LVP fuel, 23.8 mL 2-propanol, and 1.2 mL fragrance oil. The resulting mixture is burned by the aforementioned catalytic burner to emit fragrance.

As can be seen in Table 3, eight compounds were synthesized for use as low vapor pressure vapor fuels. Although Compound 10 had the second highest operating temperature (218° C.) it was given the highest S rating (2) of the eight compounds. This was due to emission of only small amounts of white smoke and the odor of the compound was only slightly noticeable over the lemongrass sage. This compound also produced no soot during the ignition process and no noticeable coke during operation.

Compounds 11-15 were all given an S rating of 3 with their intrinsic odors being detectable over the lemongrass sage. These compounds show a wide range of operating temperatures from 141 to 220° C. Compound 15 emitted less smoke during operation due to the higher temperature but the smell of the compound was much more noticeable that of Compound 10. Also, Compounds 11-15 produced no soot during the ignition process and did not produce any noticeable coke during operation.

TABLE 3

| Compound No. | Name | Bp (° C.) | Vapor Pressure (25° C., mm Hg or Torr) | No. of Carbons | Burn Temp. (° C.) | S rating |
|---|---|---|---|---|---|---|
| 10 | Oxalic acid ethyl 2-methoxyethyl ester | 210 | 0.194 | 7 | 218 | 2 |
| 11 | Oxalic acid ethyl ester diester with triethylene glycol | | | 14 | 150 | 3 |
| 12 | Oxalic acid ethyl ester diester with diethylene glycol | 377.9 | 6.5E−06 | 12 | 141 | 3 |
| 13 | Oxalic acid ethyl ester diester with ethylene glycol | | | 10 | 152 | 3 |
| 14 | Oxalic acid 2-(2-ethoxyethoxy) ethyl ethyl ester | 289 | 0.00217 | 10 | 165 | 3 |
| 15 | Oxalic acid 2-(2-ethoxyethoxy) ethyl methyl ester | | | 9 | 220 | 3 |
| 16 | Triethylene glycol monobenzoate | 367.2 | 4.87E−06 | 13 | 80 | 9 |
| 17 | 2-(2-methoxyethoxy)-4-nitrobenzoate | 374.5 | 8.33E−06 | 12 | 65 | 10 |

Example 3

Biodiesels as Used as LVP Fuels

Low vapor pressure fuel mixtures made of biodiesels were prepared as follows. The biodiesels were prepared from canola, soy, and jojoba oil (Table 4) by the following method. First, 200 mL of canola oil was added to an round bottom flask and heated to 55° C. Then, 50 mL of methanol were added along with 2.9 g of sodium hydroxide. The mixture was heated and stirred for 40 minutes and then allowed to cool to room temperature. The reaction mixture was then washed with equal volumes of DI water five times. The water was separated from the reaction mixture. The solution was allowed to sit in the separatory funnel for 5 hours. During this time the glycerine (bottom layer) separated from the biodiesel (top layer). The biodiesel was then separated and collected.

A typical composition is 75.7 mL biodiesel, 23.8 mL 2-propanol, and 0.5 mL fragrance oil. The resulting mixture is burned by the aforementioned catalytic burner to emit fragrance.

TABLE 4

| Compound No. | Name | Bp (° C.) | Vapor Pressure (25° C., mm Hg or Torr) | Burn Temp. (° C.) | S rating |
|---|---|---|---|---|---|
| 18 | Jojoba Biodiesel | | | 132 | 8 |
| 19 | Jojoba Oil | >280 | <0.01 | 114 | 9 |
| 20 | Soy Biodiesel | 315 | <1.0 | 136 | 9 |
| 21 | Canola Biodiesel | >250 | <1.0 | 140 | 9 |

Example 4

LVP Fuel with Combustion Catalyst

Low vapor pressure fuel mixtures with combustion promoters are composed of 80.7 wt % LVP fuel, 17.9 wt % alcohol, 1.3 wt % fragrance oil, and 0.005 wt % combustion catalyst. The LVP fuels (Table 1) were used as received. A typical composition is 75.7 mL LVP fuel, 23.8 mL 2-propanol, 1.2 mL fragrance oil, and 9.3 μL of 0.22 μM $RuCl_3.3H_2O$. The resulting mixture is burned by the aforementioned catalytic burner to emit fragrance.

Example 5

LVP Fuel with Combustion Promoter

Low vapor pressure fuel mixtures with combustion promoters are composed of 80 wt % LVP fuel, 18 wt % alcohol, 1.3 wt % fragrance oil, and 0.7 wt % combustion promoter. A typical composition is 74.0 mL LVP fuel, 23.8 mL 2-propanol, and 1.2 mL fragrance oil, and 1.0 mL tert-butyl peroxide. The resulting mixture is burned by the aforementioned catalytic burner to emit fragrance. Addition of the combustion promoter caused the flameless catalytic burner to operate at a higher temperature (250° C. vs 220° C.), which helped facilitate the complete combustion of the fuel and generate less smoke.

Example 6

Ethylene Glycol as an LVP Fuel

Low vapor pressure fuel mixtures are composed of 80 wt % LVP fuel, 18 wt % alcohol, and 2 wt % fragrance oil. The ethylene glycol used as received. A typical composition is 75.2 mL ethylene glycol, 23.7 mL 2-propanol, and 1.1 mL lemongrass sage fragrance oil. The resulting mixture is burned by the aforementioned catalytic burner to emit fragrance.

Ethylene glycol showed superior properties for use as a low vapor pressure fuel of all the fuels tested, including biodiesels and synthetic fuels. The operating temperature of ethylene was 274° C., which was the highest of the fuels tested. It also produced no soot during ignition and also the lowest amount of smoke of any of the compounds. After several trials there was no noticeable coke build-up. During operation the odor of the fragrance oil was highly noticeable with no interference from the ethylene glycol.

What is claimed is:

1. A system for the delivery of a volatile compound comprising a liquid fuel mixture, wherein said liquid fuel mixture comprises 1.3 wt % to 2 wt % of a volatile compound, 17.9 wt % to 18 wt % of a first compound having a vapor pressure greater than 0.5 mm Hg at 25° C., wherein said first compound is selected from the group consisting of methanol, ethanol, propanol, butanol, acetone and mixtures thereof, and 60-80 wt% of a second compound having a vapor pressure less than 0.5 mm Hg at 25° C., wherein the second compound is selected from the group consisting of ethylene glycol, triethyelene glycol, diethylene glycol, 2(2-ethoxyethoxy) ethyl acetate, triethylene glycol dimethylether, triethylene glycol monomethylether, diethylene glycol monbutyl ether acetate, diethylene glycol monoethyl ether, diethylene glycol monbutyl ether, oxalic acid ethyl ester diester, oxalic acid 2(2-ethoxyethoxy)ethyl ethyl ester, oxalic acid 2(2-ethoxy-ethoxy)ethyl methyl ester, oxalic acid ethyl 2-methoxyethyl ester and mixtures thereof, and a combustion promoter that promotes the combustion of the fuel mixture.

2. The system of claim 1, wherein the second compound has a boiling point greater than 216° C.

3. The system of claim 1, wherein said liquid fuel mixture further comprises low vapor pressure fuels selected from the group consisting of jojoba oil, jojoba biodiesel, soy biodiesel, canola biodiesel, rapeseed biodiesel and mixtures thereof.

4. The system of claim 1, wherein said liquid fuel mixture further comprises at least one catalyst that is soluble in the second compound.

5. The system of claim 4, wherein the catalyst is selected from the group consisting of ruthenium salts, magnesium salts, platinum salts, cerium salts, iron salts, transition metal ions, glyoxal and mixtures thereof.

6. The system of claim 1, wherein the combustion promoter is selected from the group consisting of hydrogen peroxide, organic peroxides, ferrocene, potassium nitrate, sodium nitrate and mixtures thereof.

7. The system of claim 1, wherein said volatile compound is a fragrance, insecticide, insect repellant, aromatherapy compound, medicinal compound, deodorizing compound, disinfectant composition, fungicide or herbicide.

* * * * *